United States Patent [19]

Koppers

[11] 4,136,999

[45] Jan. 30, 1979

[54] CANOPY AND SHIELD STRUCTURE FOR A SUPPORTING SHIELD IN A SEAM-LIKE MINE DEPOSIT

[75] Inventor: Manfred Koppers, Duisburg, Germany

[73] Assignee: Thyssen Industrie AG, Germany

[21] Appl. No.: 764,871

[22] Filed: Feb. 2, 1977

[30] Foreign Application Priority Data

Feb. 10, 1976 [DE] Fed. Rep. of Germany ..... 2605068

[51] Int. Cl.[2] ..... E21F 5/06

[52] U.S. Cl. ..... 405/295; 299/11; 405/296

[58] Field of Search ..... 61/35, 45 D; 299/11, 299/33

[56] References Cited

U.S. PATENT DOCUMENTS

| | | | |
|---|---|---|---|
| 3,874,178 | 4/1975 | Kunzer | 61/45 D |
| 3,928,981 | 12/1975 | Parker et al. | 61/45 D |

FOREIGN PATENT DOCUMENTS

| | | | |
|---|---|---|---|
| 2051875 | 4/1972 | Fed. Rep. of Germany | 61/45D |
| 2306806 | 4/1974 | Fed. Rep. of Germany | 61/45 D |
| 2324877 | 12/1974 | Fed. Rep. of Germany | 61/45 D |

*Primary Examiner*—Mervin Stein
*Assistant Examiner*—David H. Corbin
*Attorney, Agent, or Firm*—McGlew & Tuttle

[57] ABSTRACT

A canopy and shield structure for supporting a shield adjacent a working face in a seam-like mine deposit, comprises a floor skid which is connected through an extensible and contractable prop at the working face end to the working face end of a canopy adapted to be positioned in parallel relation to the roof strata. The working space is covered at the waste removal end by a shield which includes a lower two-arm lever portion which is pivotally mounted on the skid and an upper portion which is pivotally connected to the longer arm of the two-arm lever adjacent the upper end thereof and is also pivotally connected to the canopy. The two-arm lever is driven by a hydraulic drive motor and a parallel linkage is connected between the upper shield part and the canopy in order to provide a guidance of the canopy in a direction substantially perpendicular to the strata. The upper part of the shield also includes an opening for the passage of a blast pipe and the canopy advantageously includes a guideway for supporting the blast pipe for shifting movement toward and away from the working face.

4 Claims, 4 Drawing Figures

CANOPY AND SHIELD STRUCTURE FOR A SUPPORTING SHIELD IN A SEAM-LIKE MINE DEPOSIT

FIELD AND BACKGROUND OF THE INVENTION

This invention relates in general to the construction of mine shields and, in particular, to a new and useful combined canopy and shield structure for a supporting shield in a seam-like mine deposit.

DESCRIPTION OF THE PRIOR ART

The present invention relates to a canopy and shield structure particularly for a supporting shield in seam-like deposits. Shield structures of this kind are known in various designs and have proven to be quite satisfactory in the caving method of mining for many years. Their particular merit is that, upon their introduction, the number of heavy accidents has been substantially reduced. They have the further advantage that due to the separation of the working room from the worked-out area obtained by the shield, the ventilating current is concentrated, i.e., ventilating losses are avoided. For this purpose, the shield is designed so as to obtain a maximum ventilating cross-section. The large cross-section is also desirable for smooth access and for the transportation of materials, such as accessories, etc.

The reduction of the accident rate is due to the fact that immediately after its exposure, the roof can be powerfully secured by the canopy of the shield, and any caving-in cant only start at the end of the canopy, thus, in an area which is no longer dangerous.

In the caving method, it is well known to make use of a pneumatic packing which means that the worked-out area is filled with mine waste onto which the roof in the abandoned area sags. If the hanging strata are sufficiently plastic, and the cavity is completely filled out with the waste and with a satisfactory density, a rupture-free transition of the roof from the coal face to the worked-out area can be obtained. With a breaking-down roof, however, an incidental premature, falling in and, therefore, accidents and operating troubles, cannot be prevented. This occurs particularly if the cavity is not filled in an orderly fashion, which is frequently the case.

Conventionally, pneumatic packing is effected so that the filling material is conveyed through a pipe line which is suspended, behind the last row of props, either from the props or from backwardly extending roof bars and the line is provided with a blast spoon on the respective ends. The blast spoon is controlled manually and directs a jet blast discharged from the pipe line end into the space which is formed by waste-retaining wire mesh gauze which has been secured to the next-to-last prop row, the last prop row, the roof, and the floor. The pipe line comprises individual lengths which are connected to each other by express couplings. As soon as the space to be filled along the end length of the pipe line is packed, this last length is uncoupled and allowed to drop, and the blast spoon is attached to the new end of the line. This operation is very complicated and time-consuming, so that occasionally, orderly packing is neglected. The dropped pipe lengths must then be assembled again, i.e., coupled to one another, to a continuous line in the new packing area.

In order to avoid these drawbacks, a method of pneumatic packing has been developed in which the blast line can be shifted as a whole, for example, a longwall conveyor, which does not have to be disassembled. At equi-distantly spaced locations, pivotable discharge devices are mounted in the blast line, which are mechanically actuated. In one position, the conveyed filling material can pass freely in the axial direction of the line, in the other position, following a pivoting of the discharge device, a short pipe length is swung out of the line axis and instead, a discharge length angled toward the worked-out area is swung in at that location.

Such blast lines have been used also in connection with advancing support units, cf. the German periodical "Gluckauf", No. 1, 1975. In such a case, preferably, the blast line is suspended from the backwardly extending roof bars by means of rollers, or slide or rope guides, for displacement in the strike direction, i.e., away from the filling area. Designs of this kind have resulted in a considerable increase in performance.

SUMMARY OF THE INVENTION

The present invention is directed to a shield support unit which is effective as a device for controlling the roof and preventing accidents, which is improved so as to be usable also with pneumatic packing which frequently is required by operating procedures.

More particularly, the purpose of the invention is to prevent a premature caving-in or breaking-in of the roof, and to keep the ventilating current out of the worked-out area, i.e., to concentrate it to the area alongside the working face and ensure a sufficiently large cross-section therefor, while using a shiftable blast line comprising manually or hydraulically pivotable discharging devices with lateral outlets.

The invention is further directed to an arrangement of the blast line such that the line is not disposed behind the last row of supporting elements, as has been usual with advancing supports comprising frames, frameworks, trestles, or the like, nor in the worked-out area, in the triangular space formed between a backwardly extensible roof bar supported on the shield unit, and the shield itself, because here the line is inaccessible and would obstruct the vertical adjustment of the shield, but rather is located in the space in front of the working face which is separated from the filling area by the shield units. The solution of this problem is difficult with regard to the necessity of passing the line through a continuous wall of shields extending along the entire working face which are used in practice. Windowlike openings in the shield walls are unsuitable, since the possibility must be ensured to vary the inclined position of the shield wall relative to the floor in order to adapt it to the varying seam thickness, in which case, the windowlike openings would become narrower with the inclination, as viewed in the discharge direction. This would happen particularly in thin seams so that the passage of the jet blast therethrough would be inadmissibly obstructed. This difficulty is eliminated by the inventive design, while, at the same time, a positional stability of the shield is ensured which is particularly important in a shield support unit.

In accordance with the invention, the shield comprises two parts which are hinged to each other and of which the upper part, having its front end hinged to the canopy, extends, in any position, perpendicular to the stratification. The lower part of the shield has a free end hinged to the floor skid and it slants down toward the worked-out area.

In an advantageous embodiment of the invention, the lower part of the shield is formed by a long arm of an unsymmetrical bell-crank lever. A shorter arm of the lever is acted upon by a further propping element or fluid pressure drive element which extends from the floor skid substantially horizontally.

In accordance with the invention, the upper part of the shield is held in its position perpendicular to stratification by a crank mechanism which includes a parallelogram linkage constituted by the long arm of the bell-crank lever, the floor skid, the upper part of the shield, and a guide bar which acts on an extension of the upper part and is pivoted to the floor skid below the common joint of the shield and the skid.

To provide an outlet for the pneumatically conveyed filling material, the upper part of the shield may be designed in various ways. In an advantageous embodiment of the invention, the upper part of the shield comprises two supporting members which are hinged, by their one end, to the rear end of the canopy and, by their other end, to the lateral sheets of the lower part of the shield. However, the two supporting members may also be connected to each other by a plate which is provided with an opening.

In a further development of the invention, the upper part of the shield is spaced from the propping element supporting the canopy intermediate the ends thereof, by a distance which is equal to or larger than the advance step of the support units.

To avoid operational troubles during the shifting of the shield support units, the blast line is mounted for displacement on the canopy by means of either roller-, slide- or rope guides.

In order to make the inventive canopy and shield structure adaptable to variable thicknesses of the seam, both the lower part of the shield and the guide bar of the parallel-crank mechanism are telescopically adjustable and can be secured in the adjustable position.

Accordingly, it is an object of the invention to provide a canopy and shield structure for supporting a shield adjacent a working face in a seam-like mine deposit having a roof stratification, which comprises, a floor skid having a prop connected to the forward end which is extensible and contractable and which is pivotally connected at its upper end to a roof canopy which overlies the skid and is adapted to extend up to the working face of the mine and which also includes a shield extending between the skid and the roof canopy adjacent the waste removal end which includes an upper substantially vertical part which is pivoted to the canopy which is pivoted to a parallel linkage which includes a lower shield part in the form of a two-arm lever having a shorter arm which is connected to a fluid pressure operated drive therefor which is operable to move the canopy toward and away from the roof strata in a direction substantially perpendicular thereto.

A further object of the invention is to provide a canopy and shield structure for a supporting shield in a seam-like mine deposit which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

DESCRIPTION OF THE PREFERRED EMBODIMENTS

Figure 1:
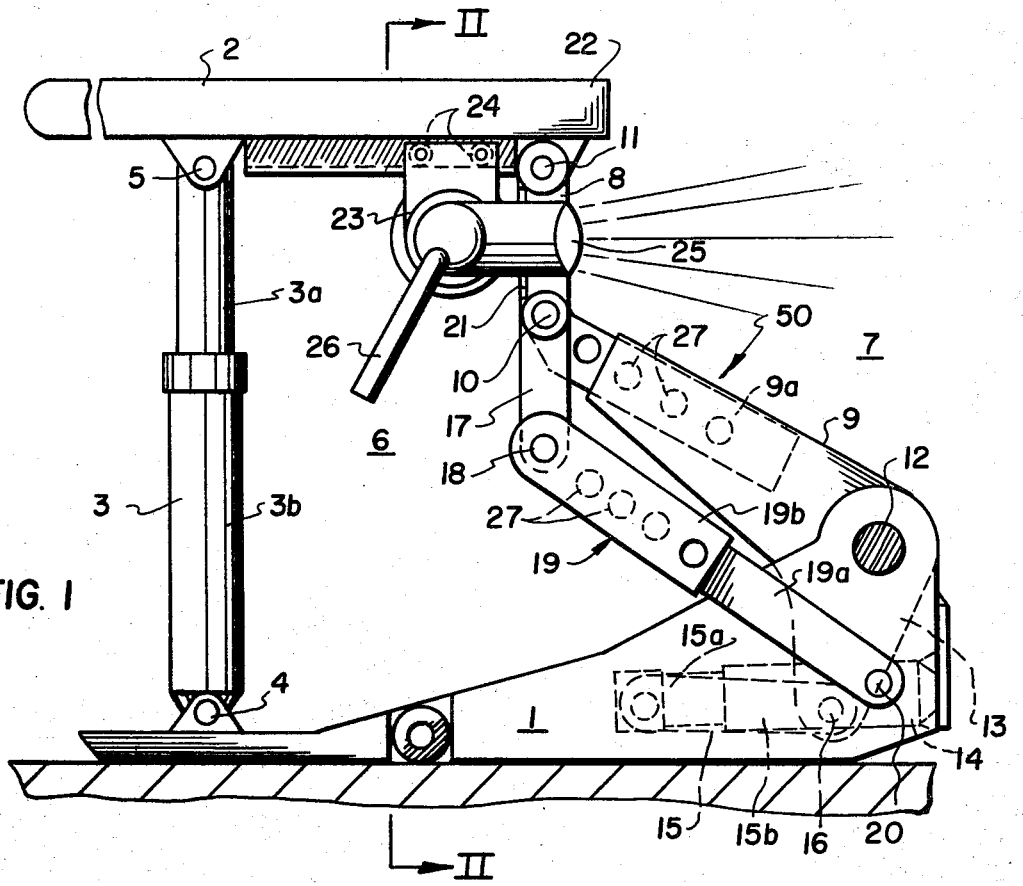
FIG. 1 is a side elevational view of a canopy and shield structure constructed in accordance with the invention.
Figure 2:
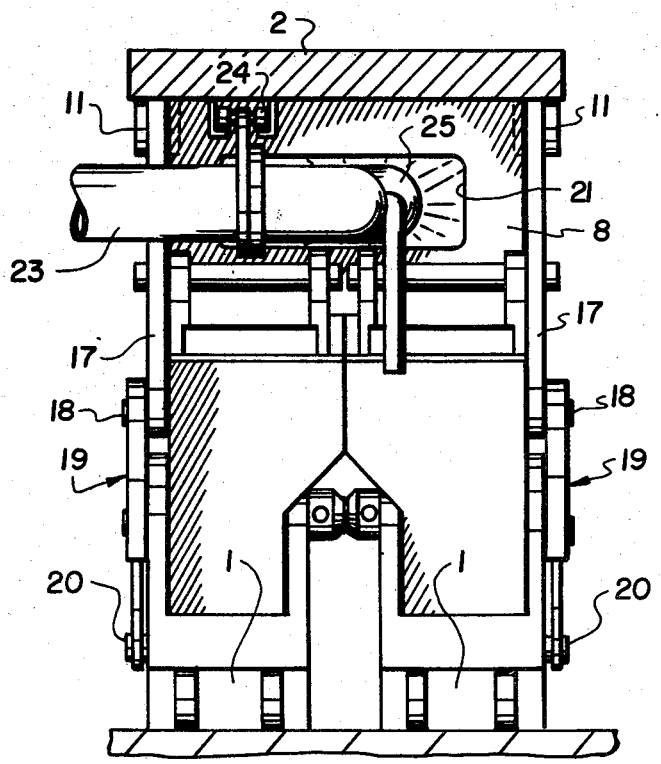
FIG. 2 is a section taken along the line II—II of FIG. 1.

Referring to the drawings in particular, the invention embodied therein in FIGS. 1 and 2, comprises a shield structure of a type which is provided with a blast line which includes a manually actuable blast spoon. This construction is in contrast to the embodiment of FIGS. 3 and 4 which is intended for arrangements in which a shiftable, closed blast line is employed which has a mechanically actuable lateral discharge outlets. In both embodiments, identical elements of the structure are designated with the same reference numerals. Only the different elements have been designated by different numerals.

In FIGS. 1 and 2, the shield support includes a floor skid 1 which is disposed below a roof canopy 2 which is supported at the face of the seam by a prop or extensible and contractable fluid pressure operated member 3 which is hinged at 4 to the skid and at its upper end on a pivot 5 to the canopy 2. The prop includes a part **3*a* which is telescopic within a part 3*b* under the control of fluid pressure which is admitted to the part 3*b* by means which have not been shown. Floor skid 1 is advantageously assembled of two parts, while canopy 2 is made of a single piece. In accordance with the invention, a shield, generally designated 50, separates a working space 6 from a worked-out area 7 and it comprises an upper part 8 and a lower part 9. The two parts 8 and 9 are connected to each other by a pivot 10. Upper part 8 supports the rear or waste delivery end 22 of canopy 2 and is hinged thereto by pivot pins 11**.

Lower part 9 of the shield 50 is formed by a long arm **9*a* of a bell-crank lever 9 which is pivoted on support bolts 12 on an upstanding bracket portion of the skid 1. Lever 9 includes a lower arm portion or short arm portion 13 which extends downwardly toward the floor and it is pivoted at 16 to a driving mechanism of piston and cylinder system 15 having a piston rod portion 15*a* which connects through a link 15*b* through the pivot 16 at one end and which has an opposite end which is pivoted to the skid 1**.

In accordance with a feature of the invention, the upper part 8 of the shield comprises axial extensions 17, 17 at the respective sides which are provided with pivot connections 18 for guide bars, generally designated 19. Guide bars 19 include other ends which are hinged to the lateral walls of the floor skid 1 at pivot connections 20 which are located vertically below the pivot bolts 12. Guide bars 19 include parts **19*a* which are telescopic within parts 19*b* and which may be locked in an adjusted position by cross-bolts 27. Guide bars 19, along with the lower part 9 of the shield and the pivots 10, 12, 18 and 20, form a parallel crank mechanism ensuring that the upper part 8 of the shield is constantly kept in a position substantially parallel to the stratification. Any mechanism suitable for maintaining the upper part of the shield 8** so that it is substantially parallel to the stratification and, if necessary, will absorb thrust forces produced in the direction of the canopy axis, may be used for obtaining a stable positioning of the support unit.

In accordance with the invention, part 8 is provided with an opening 21 through which working space 6 communicates with the worked-out space 7. In working space 6, beneath canopy 2, there is a blast conduit or line 23 which is made up of a plurality of individual sections and which is supported by means of a roller mechanism 24 so as to be displaceable in the strike direction of the seam. Shield part 8 is spaced from the propping element 3 by a distance which is equal to or larger than the average step of the support unit. At the end of blast line 23 in the embodiment of FIGS. 1 and 2, there is a so-called blast spoon 25 which is mounted for pivoting in any direction. The outlet opening of spoon 25 is aligned with the window opening 21 or, as shown in the drawing, it extends into the opening of the upper part 8 of the shield. Blast spoon 25 can be adjusted by means of a handle 26 so that it deflects a jet blast into the strike direction, that is, into the worked-out area.

Figure 3:
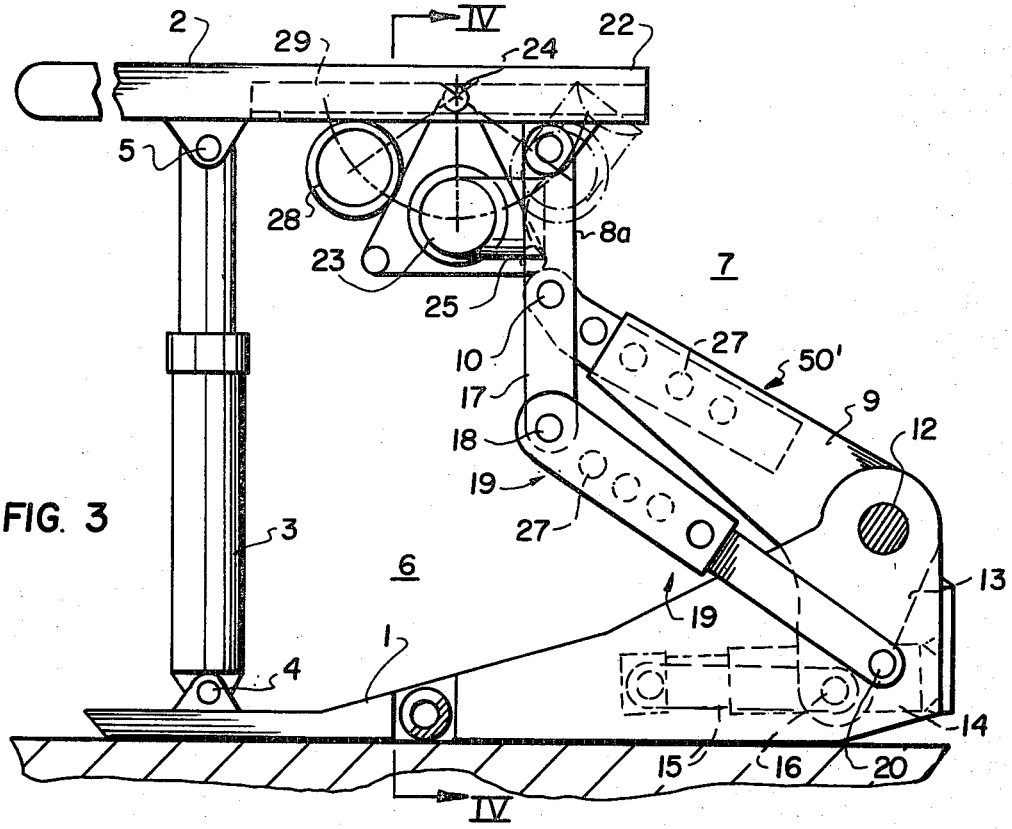
FIG. 3 is a side elevational view, similar to FIG. 1, of another embodiment of the invention.
Figure 4:
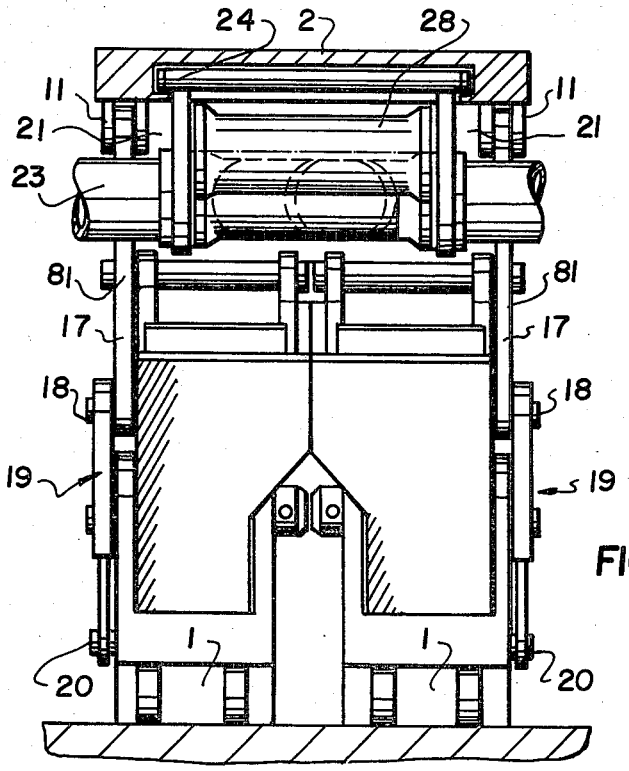
FIG. 4 is a section taken along the line IV—IV of FIG. 3.

In the embodiment of FIGS. 3 and 4, a shield 50' includes an upper part **8*a* which is formed by supporting members 81 which are mounted in the same manner as the part 8 of FIGS. 1 and 2. A passage opening 21 is formed in upper part 8 and it is of a size permitting the mounting of a blast line 23 therein which has a mechanically actuable lateral discharge outlet which corresponds to that of the blast spoon 25 of the other embodiment. In one operational stage, the lateral discharge piece is aligned with the passage 21 and in another position it extends into the passage 21. In another operational stage, the lateral discharge piece is swung out of the axis of blast line 23 into a position indicated in dotted lines so that this section may be swung away from the remaining sections. At the same time, a new length of pipe 28 is swung into position aligned with the space occupied by the previous section and is swung back into alignment with the remaining portion of the blast line 23. When the two pipes are swung outwardly away from the blast line 23**, a space is cleared for the filling material.

The mechanically operated lateral discharge piece is also guided along the underside of canopy 2 in a slide guideway 29. The openings 21 or, the spacing of the support members, if provided, offers a satisfactory possibility of observing the filling degree of the worked-out space.

The operation with both embodiments of the invention is such that after filling the abandoned area along the whole or a great part of the working face, the blast line is displaced in the direction of propping element 3 or, as shown in FIGS. 1 and 2, is newly assembled close to this element, whereupon, the shifting of the support units is effected.

While specific embodiments of the invention have been shown and described in detail to illustrate the application of the principles of the invention, it will be understood that the invention may be embodied otherwise without departing from such principles.

What is claimed is:

1. A canopy and shield structure for supporting a shield adjacent a working face and a seam-like mine depoist having a roof stratification and a working space on one side of the shield and a stowing area on the other side of the shield, comprising a floor skid, a roof canopy overlying said skid having a working end adapted to extend up to the working face of the mine deposit and having an opposite end extending away from the working face, a fluid pressure operated extensible and retractable prop having an upper end pivotally connected to said roof canopy adjacent the operating face end and an opposite end pivotally connected to said skid, a shield extending between the opposite end of said roof canopy and said floor skid including a lower part having a lower end pivotally connected to said floor skid and having an opposite upper end, a substantially vertical upper shield part having an opening therethrough pivotally connected to said roof canopy and said upper end of said lower shield part, a parallel linkage guide means connected between said upper part and said skid and said lower part for guiding said upper part for movement of said upper part to effect movement of said canopy with said upper part maintained substantially perpendicular to the roof stratification, a blast conduit having a discharge through the opening of said upper part into the stowing area, and means mounting said blast conduit in the working space.

2. A canopy and shield according to claim 1 wherein said mounting means includes guide means on said canopy for guiding said blast conduit toward and away from the opening in said upper part.

3. A canopy according to claim 2 wherein said guide for said blast conduit comprises a trackway along which said blast conduit is moveable.

4. A canopy and shield structure according to claim 2 wherein said guide for said blast conduit includes a member pivotally mounted on said canopy permitting swinging movement of said blast conduit toward and away from the opening.

* * * * *